US005216445A

United States Patent [19]

Hirasawa et al.

[11] Patent Number: 5,216,445

[45] Date of Patent: Jun. 1, 1993

[54] INK JET RECORDING METHOD USING PLURAL DOTS TO FORM EACH RECORDING UNIT

[75] Inventors: Shinichi Hirasawa, Sagamihara; Hiroyuki Maeda, Yokohama, both of Japan

[73] Assignee: Canon Kabushiki Kaisha, Tokyo, Japan

[21] Appl. No.: 856,814

[22] Filed: Mar. 24, 1992

Related U.S. Application Data

[63] Continuation of Ser. No. 463,343, Jan. 10, 1990, abandoned.

[30] Foreign Application Priority Data

Jan. 11, 1989 [JP] Japan ..... 1-002941
Jan. 11, 1989 [JP] Japan ..... 1-002942

[51] Int. Cl.[5] ..... B41J 2/05
[52] U.S. Cl. ..... 346/140 R
[58] Field of Search ..... 346/1.1, 140 R, 75

[56] References Cited

U.S. PATENT DOCUMENTS

| | | | |
|---|---|---|---|
| 4,050,077 | 9/1977 | Yamada et al. | 346/75 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,617,580 | 10/1986 | Miyakawa | 346/136 |
| 4,635,078 | 1/1987 | Sakurada et al. | 346/140 R |
| 4,642,653 | 2/1987 | Ito et al. | 346/1.1 |
| 4,692,773 | 9/1987 | Saito et al. | 346/1.1 |
| 4,723,129 | 2/1988 | Endo et al. | 346/1.1 |
| 4,740,796 | 4/1988 | Endo et al. | 346/1.1 |
| 4,748,453 | 5/1988 | Lin et al. | 346/1.1 |
| 4,856,920 | 8/1989 | Sanders | 400/124 |
| 4,860,026 | 8/1990 | Matsumoto et al. | 346/1.1 |
| 4,928,110 | 5/1990 | Inoue | 346/1.1 |

FOREIGN PATENT DOCUMENTS

| | | | |
|---|---|---|---|
| 0244604 | 11/1987 | European Pat. Off. . | |
| 56-57862 | 5/1981 | Japan . | |
| 57-89973 | 6/1982 | Japan . | |
| 57-102970 | 6/1982 | Japan . | |
| 57-102971 | 6/1982 | Japan . | |
| 58-39468 | 3/1983 | Japan . | |
| 59-123670 | 7/1984 | Japan . | |
| 59-138461 | 8/1984 | Japan . | |
| 0048365 | 3/1985 | Japan | 346/1.1 |
| 0101057 | 6/1985 | Japan | 346/1.1 |

*Primary Examiner*—Benjamin R. Fuller
*Assistant Examiner*—N. Le
*Attorney, Agent, or Firm*—Fitzpatrick, Cella, Harper & Scinto

[57] ABSTRACT

In an ink jet recording method using an ink jet recording head of an on-demand type, ink droplets are discharged at an interval which is 1/N (N is a natural number of 2 or more) of the pitch of the recording units. One recording unit is formed of a number of ink droplets equal to $N^2$.

16 Claims, 4 Drawing Sheets

INK JET RECORDING METHOD USING PLURAL DOTS TO FORM EACH RECORDING UNIT

This application is a continuation of application Ser. No. 07/463,343 filed Jan. 10, 1990, now abandoned.

BACKGROUND OF THE INVENTION

1. Field of the Invention

The present invention relates to an ink jet recording method, in particular, to an on-demand type ink jet recording method.

2. Related Background Art

Assuming that the size which substantially decides the resolution of a recording object, that is, the minimum unit of a recorded image, is called a recording unit, the recording unit of almost all of the ink jet recording methods which have conventionally been used is a dot. One dot denotes an image obtained as a result of one liquid droplet that was deposited on a recording medium such as a recording paper or the like. That is, the discharging density of liquid droplet determines the resolution after recording, namely, the recording unit.

The above point will be further described with respect to an example of a dither method as one of the image expressing methods. In the dither method, a concept of a pixel is used. One pixel comprises a plurality of dots and the gradation is expressed by changing the number of dots. That is, the dots decide the resolution of a recording object, i.e., the recording unit. Therefore, the recording unit in the dither method is determined by the dot density.

On the other hand, hitherto, a coated paper has generally been used as an ink jet recording paper. However, there is a large demand to use ordinary paper in consideration of the running costs, using efficiency, and the like. The paper which will be used most commonly in the future will certainly change from the coated paper to the ordinary paper.

There are many technical problems upon changing from the coated paper to the ordinary paper. Among them, when the conventional technique is applied to the ordinary paper, bleeding of the ink becomes anisotropic, so that a dot shape deteriorates and quality deterioration occurs. In addition, what is called a fixing time, which is the time required until a hand does not become dirty even when the hand touches the ink after completion of the printing, becomes long. The above two points are the significant subjects which are inevitable and could hinder widespread use of ordinary papers. FIGS. 1A and 1B are diagrams for explaining the fixing time.

FIG. 1A shows the case where a liquid droplet having a diameter of d was deposited onto a surface X–X' of a coated paper and became a dot of a diameter of $\alpha_a d$. FIG. 1B shows the case where a liquid droplet of the diameter of d was deposited onto the surface X–X' of the ordinary paper and became a dot of a diameter of $\alpha_b d$ and $\alpha_b$ denote ratios (hereinafter, referred to as bleeding ratios) of the dot diameter to the liquid droplet diameter. In general, the bleeding ratio of the coated paper is larger than that of the ordinary paper and there is a relation of $\alpha_a > \alpha_b$. Therefore, an amount of ink which should be received per unit area of the ordinary paper is larger than that of the coated paper. In FIGS. 1A and 1B, consideration has been made with respect to a model such that the liquid droplets having the same diameter d are transformed to the circular cylinders each having the same bottom area as that of the dot and are fixed onto the papers. In this case, heights $H_a$ and $H_b$ of the circular cylinders are proportional to the inks to be received per unit area of the papers. There is a relation of $H_a < H_b$ between the heights $H_a$ and $H_b$ of the circular cylinders on the coated paper and the ordinary paper as will be understood from FIGS. 1A and 1B. Since the fixing time increases as the circular cylinder is high, it takes a longer time to fix the ink onto the ordinary paper and such a long time causes a serious obstacle in high printing speed.

The dot shape will now be described. Unlike the coated paper, the ordinary paper does not have a special ink absorbing layer. Therefore, since the ink must be fixed into the space in which fibers and a sizing material such as a resin or the like are complicatedly mixed, the bleeding of the ink is anisotropic and the dot shape becomes complicated. Further, the ink runs along the fibers by capillarity and results in a dot with a mustache-like protrusion. In many cases, a serious adverse influence is exerted on the printing quality. Such a problem will now be considered with respect to a cylindrical model. Since an amount of ink to be received per unit area of the paper increases as the height of the circular cylinder rises, the dot shape also deteriorates. That is, for the ordinary paper, there is a tendency to deteriorate the dot shape from not only the quality of the paper but also the cylindrical model.

As mentioned above, there is a drawback such that when the recording is executed on ordinary paper by an ink jet recording method which has conventionally been used for the coated paper, both of the fixing and printing qualities deteriorate. Therefore, various methods have been proposed to solve such a drawback. For instance, according to JP-A-56-57862, JP-A-57-102970, and JP-A-57-102971, the ink of a strong base of about pH 13 is used, the sizing material or the like on the paper surface is dissolved and penetrated, thereby forming a circular dot having a good fixing performance. However, such a method has a problem of safety when dealing with the strong base. Although the ink can be preferably fixed and printed onto an acid paper using the resin or the like as a sizing material, for neutral papers in which a production amount has been increasing more and more in recent years, there is a tendency such that the fixing performance remarkably deteriorates and the printing quality also slightly deteriorates. In addition, the ink of the strong base also has a drawback such that since the permeable force of the ink of the strong base into the paper is large, the ink easily reaches the back side and it is extremely difficult to record on both sides of the paper.

SUMMARY OF THE INVENTION

In a recording method using an on-demand type ink jet recording head according to the present invention to solve the foregoing problems, ink droplets are discharged at an interval of 1/N (N is a natural number of 2 or more) of the pitch of the recording unit. Further, in an embodiment, one recording unit is recorded by a plurality of recording operations.

According to the invention, since a head which can discharge the liquid droplets at the interval of 1/N of the recording unit, for example, a head with plurality of orifices of small area provided at high density is used, an amount of ink to be received per unit area of a recording paper is reduced, thereby improving the fixing performance and the printing quality. Further, according to the embodiment, since the recording unit is divisionally recorded a plurality of number of times, the recording in which the fixing performance and the printing quality were further improved can be realized.

DETAILED DESCRIPTION OF THE PREFERRED EMBODIMENT

Figure 1A:
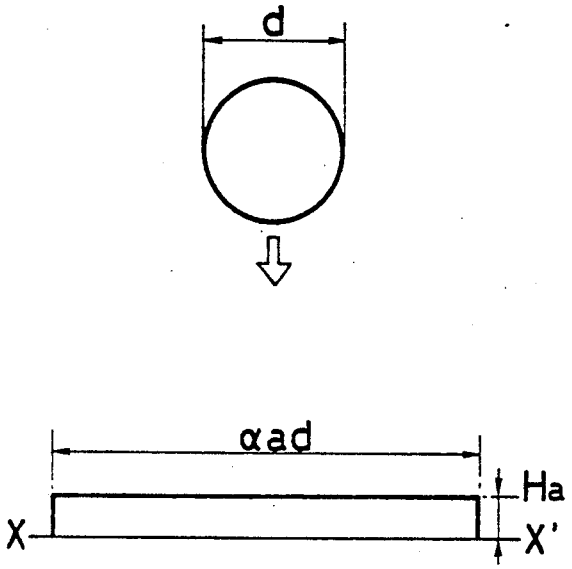
FIGS. 1A and 1B are diagrams showing the concept to explain the fixing onto a coated paper and an ordinary paper.
Figure 1B:
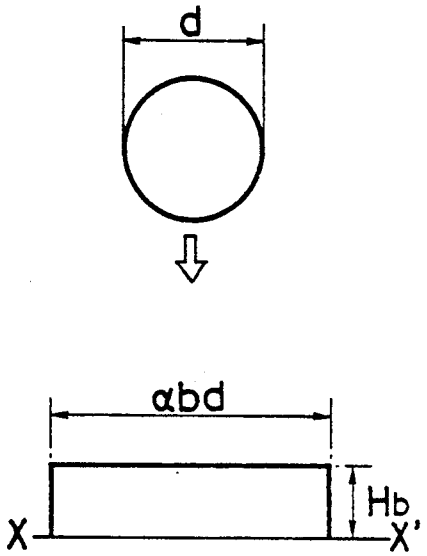
Figure 2A:
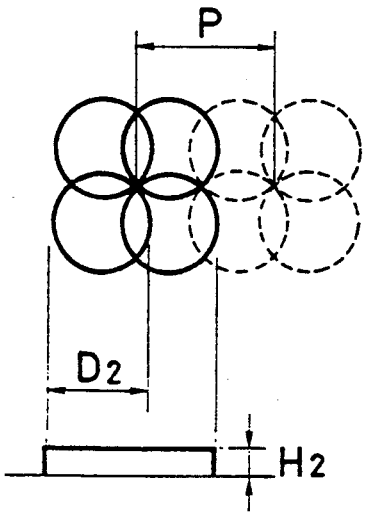
FIGS. 2A and 2B are diagrams showing a comparison between the recording method according to the embodiment of the invention and a conventional method.
Figure 2B:
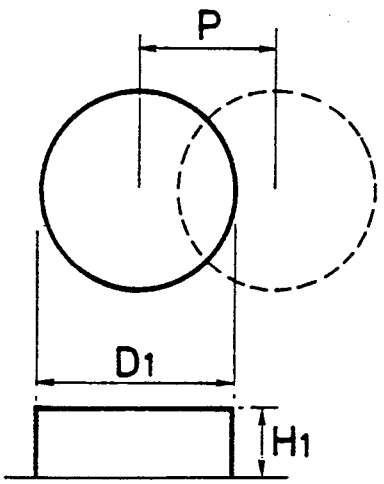

FIG. 2A shows a printing model of a recording unit which was recorded by a recording method of the invention. FIG. 2B shows a printing model according to a conventional method. The printing was executed by using a multi-orifice type ink jet head. In both of FIGS. 2A and 2B, a plan view of one recording unit when the bleeding ratio is set to 1.8 and a cylindrical model of the ink shown in FIGS. 1A and 1B are shown. A dot size is set into the minimum size so as to completely paint out the whole region without a gap in what is called a paint-out printing mode.

A circle indicated by a broken line denotes an adjacent recording unit.

In FIGS. 2A and 2B, a head which can discharge liquid droplets at a density which is twice as large as the conventional recording unit with respect to one direction, for example, a head with plurality of orifices of small areas provided at high density, and one recording unit comprises four dots. In the invention, four liquid droplets are certainly discharged in response to one recording signal and such a method fundamentally differs from the gradation expression to control the number of liquid droplets or the like.

Figure 3A:
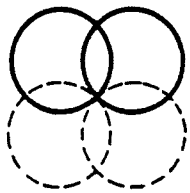
FIGS. 3A to 3D are diagrams for explaining a recording procedure in the embodiment.
Figure 3B:
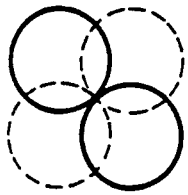
Figure 3C:
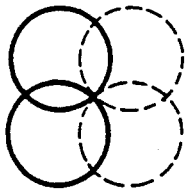
Figure 3D:
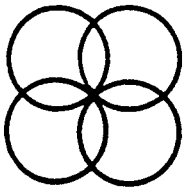
Figure 5:
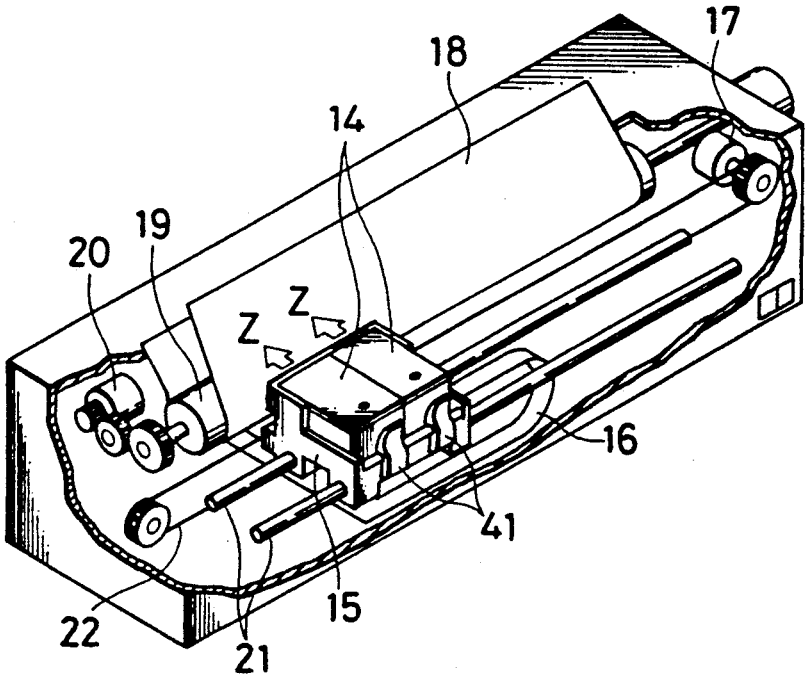
FIG. 5 is a perspective view indicating an ink jet recording apparatus for use in the ink jet recording method according to the present invention.

Further, according to the embodiment, one recording unit is divisionally printed by a plurality of (two) printing operations. FIGS. 3A to 3D show a printing method in the embodiment. In FIGS. 3A to 3C, dots which are recorded by the first printing operation are shown by solid lines. FIG. 3D shows a state after completion of the second recording operation, that is, a state after the recording unit was completed. The first printing operation is executed as shown in FIGS. 3A, 3B, or 3C and the second printing operation is then performed, thereby completing the printing of one recording unit. For example, in case that the present invention is used in a serial type ink jet recording apparatus conducting reciprocal printing as shown in FIG. 5 described in the following description, the first printing operation is executed during forward printing operation while the second printing operation is executed during reverse printing operation. In a plurality of printing operations, a method of dividing the component dots and printing is not limited to the method in the embodiment.

The embodiment will now be described with reference to FIGS. 2A and 2B.

$D_1$ and $H_1$ denote a dot diameter and a height of a cylindrical model according to the conventional printing method. $D_2$ and $H_2$ denote a dot diameter and a height of a cylindrical model in the present invention. In the invention, since a recording unit is constructed by a plurality of dots, it is improper to model the recording unit by a circle. Therefore, each dot is constructed by a circle and the result which is obtained by dividing the volume of liquid droplets by the area which is occupied by a set of the dots is set to a height of a cylindrical model. In the case of the embodiment, $H_2$ is set to the value which is obtained by dividing the volume of four liquid droplets by the area of the recording unit in FIG. 2A.

The invention intends to improve the fixing performance and the printing quality by setting the value of $H_2$ to be smaller than that of $H_1$. When one liquid droplet is fixed onto the paper, the fixing time is specified as follows.

$$\text{Fixing time} \propto \frac{\text{Volume of liquid droplet}}{\text{Dot area}}$$

That is, there is a proportional relation between the height of cylindrical model and the fixing time. In the case of the embodiment, the following relation is satisfied irrespective of the size of recording unit.

$$H_1:H_2 = 1.0:0.61$$

The above relation can be proved by the geometric calculations and will be explained hereinbelow.

It is now assumed that the recording head can discharge liquid droplets at a density which is n times as large as the natural number of the resolution of the recording unit and one recording unit is recorded at a pitch of p. It is also assumed that recording is executed such that a recording area can be fully painted out without a gap in what is called a paintout printing mode. Therefore, assuming that the bleeding ratio of the paper is set to B and a dot diameter when the natural number is set to n (the conventional method corresponds to n=1) is set to $D_n$ and a liquid droplet diameter is set to $d_n$, the following relation is satisfied.

$$D_n = \sqrt{2} \times \frac{p}{n}, \; D_n = B \times d_n$$

$$d_n = \frac{\sqrt{2}}{B} \cdot \frac{p}{n}$$

Therefore, an ink amount $V_n$ per recording unit is $$V_n = \frac{1}{n} \cdot \frac{\sqrt{2}}{3} \pi \left(\frac{p}{B}\right)^3$$

An area $S_n$ of the recording unit is $$S_n = \frac{p^2}{2n} (2n - 2 + \pi)$$

Thus, the height $H_n$ of cylindrical model is $$H_1 = \frac{V_1}{S_1} = \frac{2\sqrt{2}}{3} \cdot \frac{p}{B^3}$$

because n=1 in the case of the conventional method, and $$H_n = \frac{V_n}{S_n}$$

$$= \frac{2\sqrt{2}}{3} \cdot \frac{p}{B^3} \cdot \frac{\pi}{2n - 2 + \pi}$$

$$= H_1 \cdot \frac{\pi}{2(n-1) + \pi}$$

in the case of the present invention. The ratio between $H_1$ and $H_n$ is $$H_1:H_n = 1:\frac{\pi}{2(n-1) + \pi}$$

Table 1 shows the values in the cases from n=1 to n=10. n=1 corresponds to the conventional case.

FIGS. 2A and 2B correspond to the case of n=2. From Table 1, it will be understood that as compared with the conventional case, by merely setting n=2, the effect to lower the height of ink of the cylindrical model is very large and the fixing time can be remarkably reduced and the dot shape is also improved.

TABLE 1

| n | $\frac{\pi}{2(n-1)+\pi}$ |
|---|---|
| 1 | 1.00 |
| 2 | 0.61 |
| 3 | 0.44 |
| 4 | 0.34 |
| 5 | 0.28 |
| 6 | 0.24 |
| 7 | 0.21 |
| 8 | 0.18 |
| 9 | 0.16 |
| 10 | 0.15 |

Further, as shown in FIGS. 3A to 3D, in the invention, one recording unit is constructed by a plurality of, particularly, two printing operations. Therefore, a height $H_{21}$ of cylinder per recording operation is further reduced. In the case of the two printing operations, in FIGS. 3A and 3C, $$H_2:H_{21} = 1:0.900$$

$$H_1:H_{21} = 1:0.550$$

in FIG. 3B, $$H_2:H_{21} = 1:0.818$$

$$H_1:H_{21} = 1:0.500$$

Figure 4A:
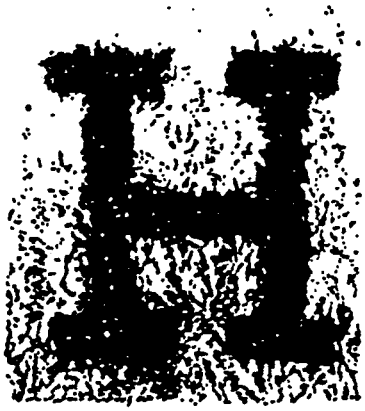
FIGS. 4A and 4B are schematic illustrations of microscopic photographs showing the printed result according to the conventional technique and the printed result according to the invention.
Figure 4B:
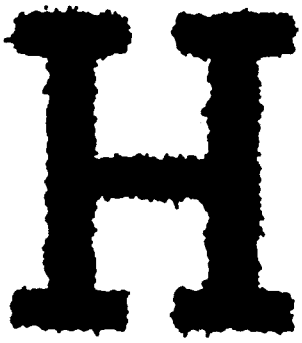

The height of cylindrical model further decreases, the fixing time is reduced, and the dot shape is also further improved. FIGS. 4A and 4B schematically show optical microscopic photographs of a printed sample (a) according to the conventional example and a printed sample (b) according to the embodiment. It will be understood from the diagrams that the bleeding of the printed sample in the invention is smaller and the printed image is clearer than those in the conventional method.

According to the invention, the ink height of the cylindrical model is reduced and the fixing time can be reduced. Therefore, for instance, the high speed printing by the multi-orifice head with orifices arranged corresponding to the A4 width can be also realized. On the other hand, not only the dot shape is improved but also a printed image is constructed by dots smaller than those in the conventional method, so that there are also advantages such that the printed image is finely expressed and the printing quality is further improved.

Referring to FIG. 5, 14 denotes an ink jet recording head cartridge of disposable type with a plurality of orifices of small areas provided at high density. The cartridge 14 is fixed on a carriage 15 by a holding member 41. They are movable reciprocally along a shaft 21 in the longitudinal direction. Positioning with respect to the carriage 15 is defined, for example, by a hole at a support and a dowel or the like at the side of the carriage 15. Further, the electrical connection may be formed by coupling a connector on the carriage 15 with a connection pad at a wiring plate.

An ink discharged from the orifice (not shown in FIG. 5) of the recording head 14 reaches a recording medium 18, the recording surface of which is positioned by a platen 19 slightly distant from the recording head, so that an image is formed on the recording medium 18.

The recording head is provided with discharge signals according to image data from a suitable data source through a cable 16 and connection terminal coupled thereto. As the cartridge 14, one or plural (two in the drawing) may be used according to ink colors used therein.

Further, in FIG. 5, 17 denotes a carriage motor for scanning the carriage 15 along the shaft 21. Numeral 22 denotes wire for transmitting a driving power of the motor 17 to the carriage 15. Numeral 20 denotes a feed motor coupled with a platen roller 19 for conveying the recording medium 18.

In case of using the serial type ink jet recording apparatus as shown in FIG. 5, as a more preferable example of usage of the recording method according to the present invention, the following example is proposed.

That is, two ink jet recording heads 14 are provided. (a) One has orifices of normal size and arrangement. (b) The other has plural orifices of small sizes provided at high density. When high quality printing is necessary, the head (b) is used. The printing is executed according to the present invention. When high quality is not necessary while high speed printing is necessary, the head (a) is used and normal printing is executed. That is, plural modes including a mode for discharging ink droplets at the interval of the 1/N of the pitch of recording units (N is a natural number of 2 or more), and a mode for discharging the droplets at the interval of recording unit pitch, are executed according to the recording method.

The present invention brings about excellent effects particularly in a recording head or recording device of the bubble jet system.

As to its representative construction and principle, for example, the basic principles disclosed in, for instance, U.S. Pat. Nos. 4,723,129 and 4,740,796 are preferred. The above system is applicable to either of the so called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the construction of the recording head, in addition to the combination of constructions of discharging orifice, liquid channel, electricity-heat converter (linear liquid channel or right angle liquid channel) as disclosed in the above-mentioned respective specifications, the construction by use of U.S. Pat. Nos. 4,558,333 and 4,459,600 disclosing the construction having the heat acting portion arranged in the flexed region is also included in the present invention. In addition, the present invention can be also effectively made the construction as disclosed in Japanese Patent Laid-Open Application No. 59-123670 which discloses the construction using a slit common to a plurality of electricity-heat converters as the discharging portion of the electricity-heat converter or Japanese Patent Laid-Open Application No. 59-138461 which discloses the construction having the opening for absorbing the pressure waves of heat energy corresponding to the discharging portion.

Further, as the recording head of the full line type having a length corresponding to the maximum width of the recording medium which can be recorded by the recording device, either the construction which satisfies its length by combination of a plurality of recording heads as disclosed in the above-mentioned specifications or the construction of one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, the addition of a restoration means for the recording head, a preliminary auxiliary means, etc. provided in the construction of the recording device of the present invention is preferable, because the effect of the present invention can be further stabilized. Specific examples may include, for the recording head, capping means, cleaning means, pressurization or aspiration means, electricity-heat converters or another heating element or preliminary heating means, or a combination of them, and it is also effective for performing stable recording to include a preliminary mode which performs discharging separate from recording.

Further, as the recording mode of the recording device, the present invention is extremely effective for not only the recording mode only of a primary stream color such as black etc., but also a device equipped with at least one of plural different colors or full color by color mixing, whether the recording head may be either integrally constructed or combined in plural number.

We claim:

1. An ink jet recording method for use with an ink jet recording head, said method comprising the step of:

discharging ink as droplets, responsive to a single recording signal, to form a single recording unit, the droplets being discharged at an interval which is 1/N of a pitch of adjacent recording units, N being a natural number of 2 or more, wherein the pitch is a distance between centers of the adjacent recording units, and wherein each recording unit comprises $N^2$ droplets, the $N^2$ droplets each having a minimum diameter in order to completely cover an area bound by the recording unit.

2. An ink jet recording method according to claim 1, wherein the ink jet recording head comprises a serial recording head, and one recording unit is recorded by a plurality of recording operations.

3. An ink jet recording method according to claim 2, wherein a number of said recording operations is two.

4. An ink jet recording method according to claim 1, wherein the ink discharge is achieved by means of thermal energy.

5. An ink jet recording method comprising the steps of:

in a first mode, discharging ink as droplets, responsive to a single recording signal, to form a single recording unit, the droplets being discharged at an interval which is 1/N of a pitch of adjacent recording units, N being a natural number of 2 or more, wherein the pitch is a distance between centers of the adjacent recording units, and wherein each recording unit comprises $N^2$ droplets, the $N^2$ droplets each having a minimum diameter in order to completely cover an area bound by the recording unit; and in a second mode, discharging the ink as droplets at an interval equal to the pitch of adjacent recording units, wherein the second mode performs an operation with a lower quality recording but a higher recording speed than an operation of the first mode.

6. An ink jet recording apparatus comprising:

an ink jet recording head for discharging ink; and a control means for controlling said ink jet recording head so that ink is discharged as droplets, responsive to a single recording signal, to form a single recording unit, the droplets being discharged at an interval which is 1/N of a pitch of adjacent recording units, N being a natural number of 2 or more, wherein the pitch is a distance between centers of the adjacent recording units, and wherein each recording unit comprises $N^2$ droplets, the $N^2$ droplets each having a minimum diameter in order to completely cover an area bound by the recording unit.

7. An ink jet recording apparatus according to claim 6, wherein the ink discharge is achieved by means of thermal energy.

8. An ink jet recording apparatus comprising:

a first ink jet recording head for discharging ink as droplets, responsive to a single recording signal, to form a single recording unit, the droplets being discharged at an interval which is 1/N of a pitch of adjacent recording units, N being a natural number of 2 or more, wherein the pitch is a distance between centers of the adjacent recording units, and wherein each recording unit comprises $N^2$ droplets, the $N^2$ droplets each having a minimum diameter in order to completely cover an area bound by the recording unit; and a second ink jet recording head for discharging the ink as droplets at an interval equal to the pitch of adjacent recording units, wherein said second ink jet recording head performs an operation with a lower quality recording but with a higher recording speed than an operation of said first ink jet recording head.

9. An ink jet recording apparatus according to claim 8, wherein the ink discharge is achieved by means of thermal energy.

10. An ink jet recording apparatus according to claim 8, wherein ink discharge orifices of said first ink jet recording head are smaller and are arranged in a higher density than ink discharge orifices of said second ink jet recording head.

11. An ink jet recording method for use with an ink jet recording head, said method comprising the steps of:

discharging ink as droplets, responsive to a single recording signal, to form a single recording unit, the droplets being discharged at an interval which is 1/N of a pitch of adjacent recording units, N being a natural number of 2 or more, wherein the pitch is a distance between centers of the adjacent recording units; and repeating the discharging step at least N times, wherein each recording unit comprises at least N droplets, the at least N droplets each having a volume sufficient to completely cover an area bound by the recording unit.

12. An ink jet recording method according to claim 11, wherein said repeating step is conducted per each serial scanning of said recording head.

13. An ink jet recording method according to claim 11, wherein ink discharge is effected by means of thermal energy.

14. An ink jet recording apparatus comprising:

an ink jet recording head for discharging ink; and control means for controlling said ink jet recording heads so that ink is discharged as droplets, responsive to a single recording signal, to from a single recording unit, the droplets being discharged at an interval which is 1/N of a pitch of adjacent recording units, N being a natural number of 2 or more wherein the pitch is a distance between centers of the adjacent recording units, and wherein each recording unit comprises at least N droplets, the at least N droplets each having a diameter sufficient to completely cover an area bound by the recording unit.

15. An ink jet recording apparatus according to claim 14, further comprising scanning means for scanning said recording head.

16. An ink jet recording apparatus according to claim 14, wherein the ink discharge is effected by means of thermal energy.

* * * * *

UNITED STATES PATENT AND TRADEMARK OFFICE

CERTIFICATE OF CORRECTION

PATENT NO. : 5,216,445

DATED : June 1, 1993

INVENTOR(S) : SHINICHI HIRASAWA, ET AL.

It is certified that error appears in the above-identified patent and that said Letters Patent is hereby corrected as shown below:

COLUMN 1:

Line 59, "$\alpha_b$d and $\alpha_b$" should read --$\alpha_b$d. $\alpha_a$ and $\alpha_b$--.

COLUMN 2:

Line 11, "in" should read --in realizing--.

COLUMN 10:

Line 17, "heads" should read --head--.

Signed and Sealed this

Tenth Day of May, 1994

Bruce Lehman

BRUCE LEHMAN

*Commissioner of Patents and Trademarks*

*Attest:*

*Attesting Officer*